US009647372B2

(12) United States Patent
Eckel

(10) Patent No.: US 9,647,372 B2
(45) Date of Patent: May 9, 2017

(54) HIGH-VOLTAGE FINGER PROTECTION

(71) Applicant: TE Connectivity Germany GmbH, Bensheim (DE)

(72) Inventor: Markus Eckel, Burstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/939,606

(22) Filed: Nov. 12, 2015

(65) Prior Publication Data

US 2016/0064849 A1 Mar. 3, 2016

Related U.S. Application Data

(63) Continuation of application No. PCT/EP2014/060560, filed on May 22, 2014.

(30) Foreign Application Priority Data

May 24, 2013 (DE) ..... 10 2013 209 690

(51) Int. Cl.
*H01R 13/44* (2006.01)
*H01R 24/66* (2011.01)
*H01R 13/04* (2006.01)

(52) U.S. Cl.
CPC ..... *H01R 13/44* (2013.01); *H01R 24/66* (2013.01); *H01R 13/04* (2013.01); *H01R 2201/26* (2013.01)

(58) Field of Classification Search
CPC ..... H01R 13/03
USPC ..... 439/693
See application file for complete search history.

(56) References Cited

U.S. PATENT DOCUMENTS 4,012,103 A * 3/1977 Lunquist ..... H01R 13/703 200/51.09
6,146,211 A * 11/2000 Okamoto ..... H01R 13/04 439/181
2013/0090012 A1 4/2013 Natter et al.
2013/0237074 A1* 9/2013 Yagome ..... H01R 13/44 439/135

FOREIGN PATENT DOCUMENTS

DE 102010035943 A1 3/2012
GB 2276779 A 10/1994

OTHER PUBLICATIONS

PCT International Search Report, International Application No. PCT/EP2014/060560, dated Jul. 9, 2014, 4 pages.
Abstract for DE 102010035943(A1), dated Mar. 1, 2012, 2 pages.

* cited by examiner

*Primary Examiner* — Ross Gushi
(74) *Attorney, Agent, or Firm* — Barley Snyder

(57) ABSTRACT

An electrical pin contact is disclosed. The electrical pin contact has a free end, a base spaced apart from the free end and connected to a plug type connector, and an electrically insulating contact protection member extending from the base to the free end. The contact protection member forms an outer face between the base and the free end.

17 Claims, 14 Drawing Sheets

HIGH-VOLTAGE FINGER PROTECTION

CROSS-REFERENCE TO RELATED APPLICATIONS

This application is a continuation of PCT International Application No. PCT/EP2014/060560 filed May 22, 2014, which claims priority under 35 U.S.C. §119 to German Patent No. 10 2013 209 690.9, filed May 24, 2013.

FIELD OF THE INVENTION

The invention relates to an electrical pin contact, and more particularly to an electrical pin contact of a high-current and/or high-voltage plug type connector.

BACKGROUND

Electrical pin contact elements are known from the prior art. The pin contact elements are used, for example, to connect an electrical system of a car to the battery or accumulator thereof. In the case of electric vehicles or hybrid vehicles which are partially or completely driven by electric current, very large currents and/or voltages are transmitted via the connector elements and consequently the plug type contacts fitted therein. The pin contact elements may be so-called flat or round contacts. Flat contacts have the advantage over round contacts that they can generally be used in two different insertion directions or in the case of angled (90°) and straight (180°) plug type connectors, whereas different types have to be provided for the two types of plug type connectors in the case of round contacts, which increases the number of different components to be produced and stored for the plug type connectors.

A large number of connector elements for which contact of the contact elements is intended to be prevented in various manners are known from the prior art. The contact elements themselves may be provided with contact protection members or be concealed by means of movable contact protection devices when the plug type connectors are in an open state so that they comply with the corresponding standards or provisions for contact protection.

For example, the publication DE 10 2010 035 943 A1 discloses a plug type connector for high-voltage applications having a housing, on which electrically insulating walls are formed and project beyond the upper edges and lateral edges of a flat connector pin which is retained by the housing to such an extent that a human finger is intended to be able to touch the edges of the walls without achieving touching contact with the flat connector pin. Such a contact element, however, is complex to produce and susceptible to failure.

SUMMARY

An object of the invention is to provide a pin contact by means of which a robust contact protection can be provided in a manner which is as simple and cost-effective as possible. The disclosed electrical pin contact has a free end, a base spaced apart from the free end and connected to a plug type connector, and an electrically insulating contact protection member extending from the base to the free end. The contact protection member forms an outer face between the base and the free end.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
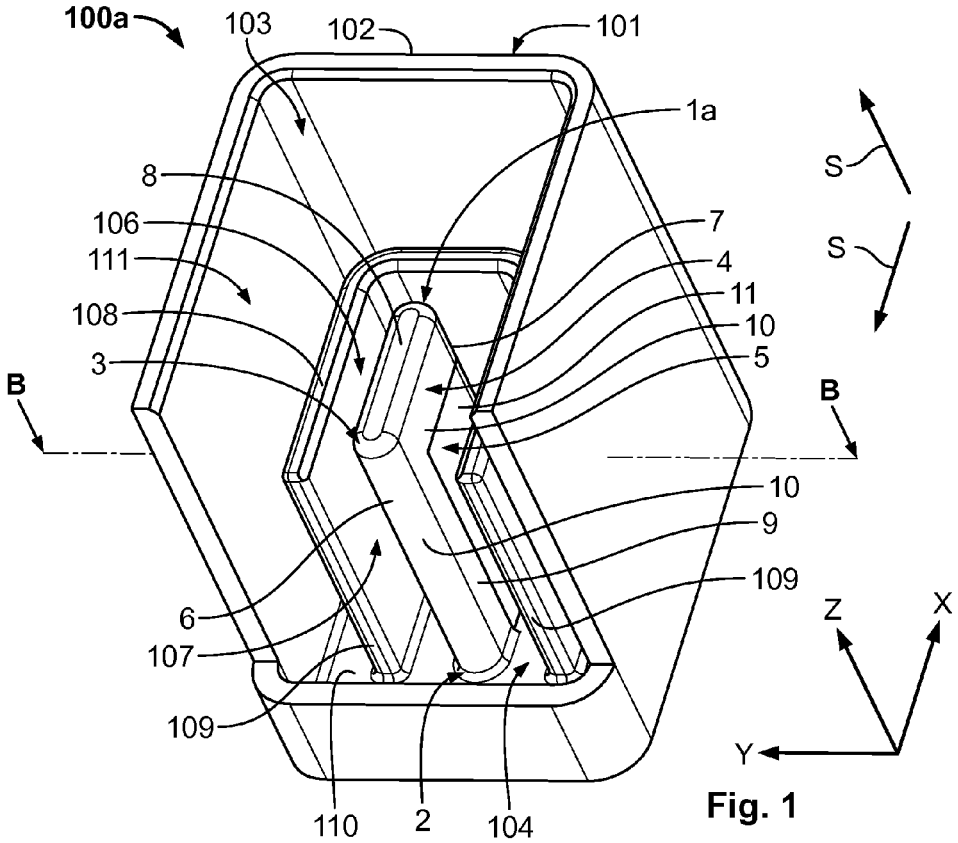
FIG. 1 is a perspective view of a first embodiment of a connector element according to the invention with a first embodiment of a pin contact element according to the invention.

The invention is described below in greater detail by way of example with reference to possible embodiments and the appended drawings. This invention may, however, be embodied in many different forms and should not be construed as limited to the embodiments set forth herein; rather, these embodiments are provided so that this disclosure will be thorough and complete and still fully convey the scope of the invention to those skilled in the art.

First, a first embodiment of a connector element 100*a* according to the invention, which embodiment is provided with a first embodiment of a pin contact element 1*a* according to the invention, is described with reference to FIG. 1. The connector element 100*a* extends in a longitudinal direction X, a transverse direction Y and a vertical direction Z which together define a Cartesian coordinate system. In the vertical direction Z, the connector element 100*a* can be connected in an insertion direction S to a mating connector element (not shown) or the pin contact element 1*a* can be connected to a counter-contact element, such as, for example, a socket contact element (not shown). In another insertion direction S', the connector element 100*a* can be connected to another or the same mating connector element or the pin contact element 1*a* can be connected to another or the same counter-contact element, with the additional insertion direction S' extending counter to the longitudinal direction X. Consequently, the pin contact element 1*a* and the connector element 100*a* can be used in 180° and/or 90° plug type connectors in accordance with the insertion direction S or the additional insertion direction S'.

The pin contact element 1*a* is in the form of a so-called flat contact and has a base 2 and a free end 3. A contact protection member 4 of the pin contact element protects a contact member 5 of the pin contact element 1*a* from inadvertent contact. The contact protection member 4 extends from the base 2 as far as the free end 3 in the insertion direction S along a front outer edge 6 and partially along a rear outer edge 7 of the pin contact element 1*a* and transversely relative to the insertion direction S or in the additional insertion direction S' along a front side 8 of the pin contact element 1*a*. Consequently, the contact protection member 4 forms an outer face 10' of a front-side contact protection portion 9 and a front-side contact protection portion 10 which partially surround a first contact face 11 of the contact member 5, which face is directed counter to the transverse direction X, and a second contact face 12 (see FIGS. 3 and 4) of the contact member 5, which face is directed in the transverse direction Y.

The connector element 100*a* has a housing 101 which is constructed in the manner of a pin receptacle. The housing 101 has a wall 102 which surrounds the pin contact 1*a* and projects in the vertical direction Z. There are formed in the wall 102 an upper wall opening 103, from which the pin contact element 1*a* is accessible counter to the insertion direction S, and a lateral wall opening 104, from which the pin contact element 1*a* is accessible counter to the additional insertion direction S'.

A contact protection collar 105 of the connector element 100*a* is formed between the wall 102 and the pin contact element 1*a*. Similarly to the wall 102, the contact protection collar 105 has an upper collar opening 106 and a lateral collar opening 107. The pin contact element 1*a* is accessible via the upper collar opening 106 counter to the insertion direction S. The pin contact element 1*a* is accessible via the lateral collar opening 107 counter to the additional insertion direction S'. An upper collar edge 108 is arranged in the vertical direction Z or insertion direction S below or in front of the front side 8 of the pin contact element 1*a*. In other words, the front side 8 projects beyond the upper collar edge 108 in the vertical direction Z and in the insertion direction S. Lateral collar edges 109 of the contact protection collar 105 are arranged in the lateral direction X or counter to the additional insertion direction S' in front of the front outer edge 6 or the front-side contact protection portion 9.

A base 110 of the connector element 100*a* substantially extends in a plane which is defined in the longitudinal direction X and transverse direction Y and consequently delimits a mating connector receiving member 111 of the connector element 100*a*, which mating connector receiving member 111 is formed by pin contact elements 1*a*, a wall 102 and a contact protection collar 105 and is constructed in accordance with the respective requirements so as to correspond to a mating connector element (not shown) for the connector element 100*a*. The bottom 110 may be constructed, as in the present embodiment, integrally with the pin contact element 1*a* by the material of the bottom 110 merging in the region of the base 2 into the material of the pin contact element 1*a* or the contact protection member 4 thereof. The contact protection collar 105 and the wall 102 may also, as in the present embodiment, be constructed integrally in the bottom 110. In other words, the housing 101 comprising the wall 102, the contact protection collar 108 and the bottom 110 may be integrally formed with the contact protection member 4 or the base 2, whereby the pin contact element 1*a* is integrally formed with the connector element 100*a*.

Figure 2:
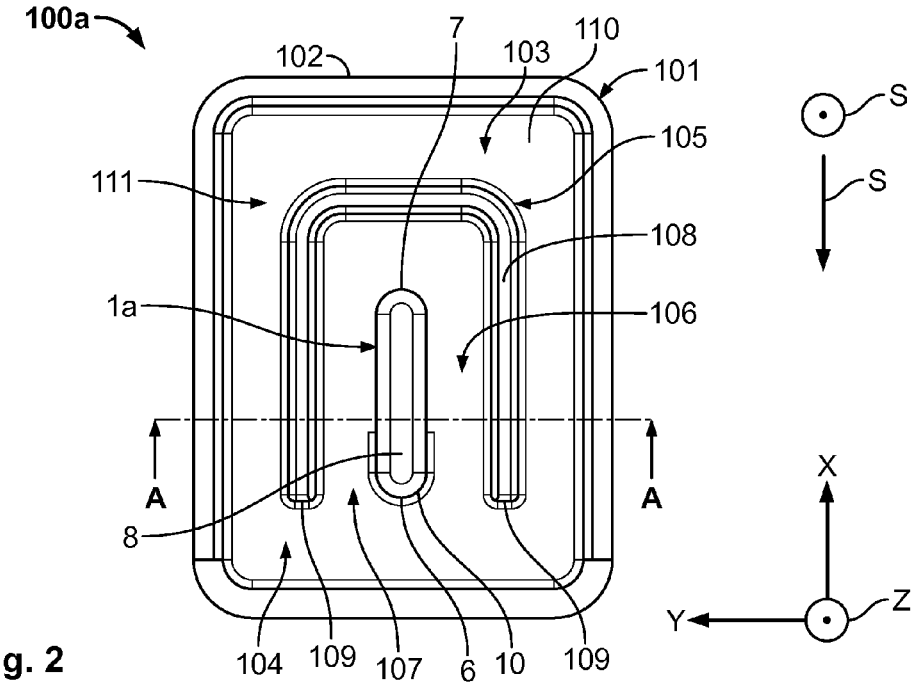
FIG. 2 is a top view of the connector element of the first embodiment.

FIG. 2 is a schematic top view of the pin contact element 1*a*. This shows that the pin contact element 1*a* is surrounded at three sides by the contact protection collar 105 and the contact protection collar 105 is surrounded at three sides by the wall 102. Thus, the pin contact element 1*a*, the contact protection collar 105 and the wall 102 together form a mating connector receiving member 111 or the insertion face thereof. Spacings measured in the transverse direction Y between the pin contact element 1*a* and the contact protection collar 105, the height of the collar 105 and the height of the front-side contact protection portion 9 and the length of the front-side contact protection portion 10 have such dimensions that a test finger abuts the front outer edge 6 and the lateral collar edge 109 or the upper collar edge 108 and the front side 8 without being introduced as far as the contact faces 11 and 12.

Figure 3:
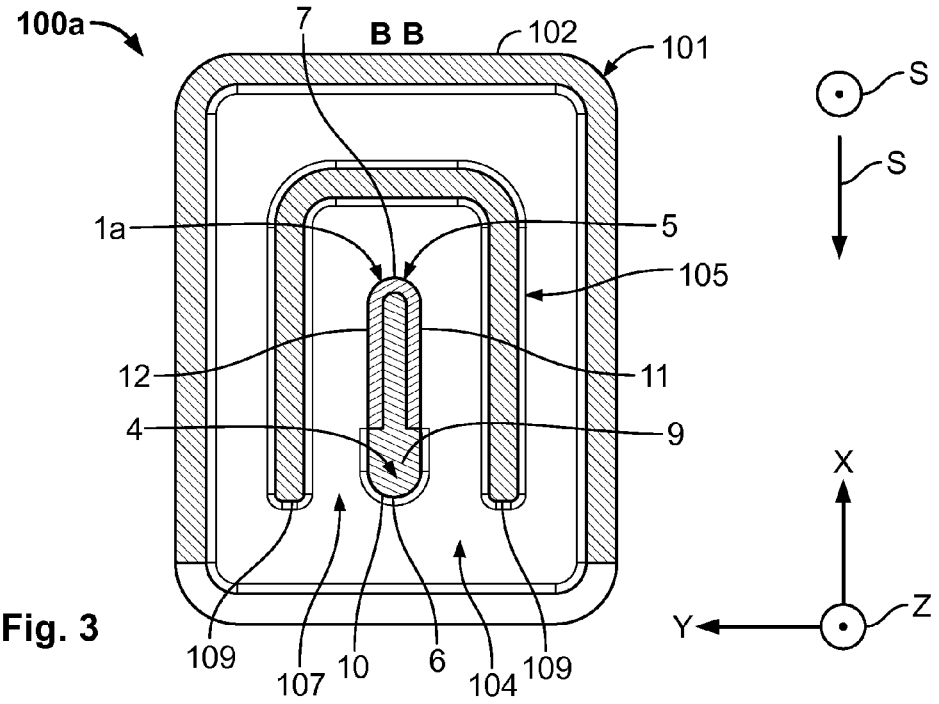
FIG. 3 is a cross-section view of the connector element of the first embodiment along the line of section B-B indicated in FIG. 1.

FIG. 3 is a schematic cross-section of the pin contact element 1*a* along the line of section B-B indicated in FIG. 1, that is to say, in a plane defined by the lateral direction X and transverse direction Y. This shows that the contact member 5 is U-like in cross-section, the longitudinal members of the U-shape forming the first contact face 11, the second contact face 12 and the yoke of the U-shape partially forming the rear outer edge 7 of the pin contact element 1*a*. Material of the contact protection member 4 extends inside the U-shape. In other words, the contact member 5 is filled with material of the contact protection member 4. Consequently, the contact protection member 4 and the contact member 5 form a positive-locking unit which contributes to the stability of the pin contact element 1*a*, in particular to the moment of resistance thereof counter to bending forces which act in the Y direction on the front-side contact protection portion 9.

Figure 4:
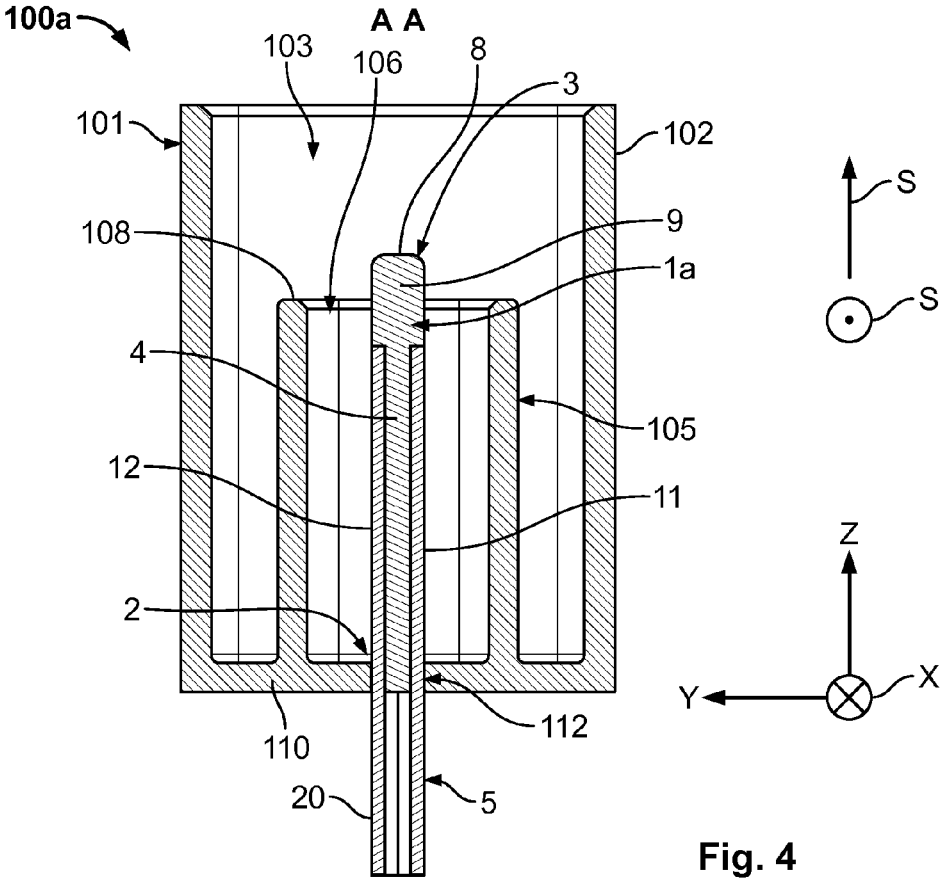
FIG. 4 is a cross-section view of the connector element of the first embodiment along the line of section A-A indicated in FIG. 2.

FIG. 4 is a schematic perspective view of the pin contact element 1*a* along the line of section A-A indicated in FIG. 2 or in a plane which is defined by the transverse direction Y and the vertical direction Z. This shows that the contact protection member 4 or the front-side contact protection portion 9 thereof projects beyond the upper collar edge 108. In the region of the rear outer edge 7, the front outer edge 6 and the lateral face of the front-side contact protection portion 9, the contact protection member 4 is aligned with the contact member 5. In other words, the lateral faces of the front contact protection portion 9 are aligned with the first contact face 11 and the second contact face 12 in a projection in the insertion direction S. The front contact protection portion 9 or the front-side contact protection portion 8 and the first contact face 11 and the second contact face 12 are further aligned in a projection in the additional insertion direction S'.

Furthermore, in the bottom 110 of the pin contact element 1*a*, a contact receiving member 112 of the connector element 100*a* is in the form of an opening extending in the insertion direction S so as to correspond to the cross-section of the contact member 5. The contact member 5 extends through the contact receiving member 112 as far as a location below the bottom 110 so that a connection portion 20 of the contact member 5 is exposed and can be connected to an electrical conductor (not shown) in an electrically conductive manner, which connection portion 20 is constructed in accordance with respective requirements.

Figure 5:
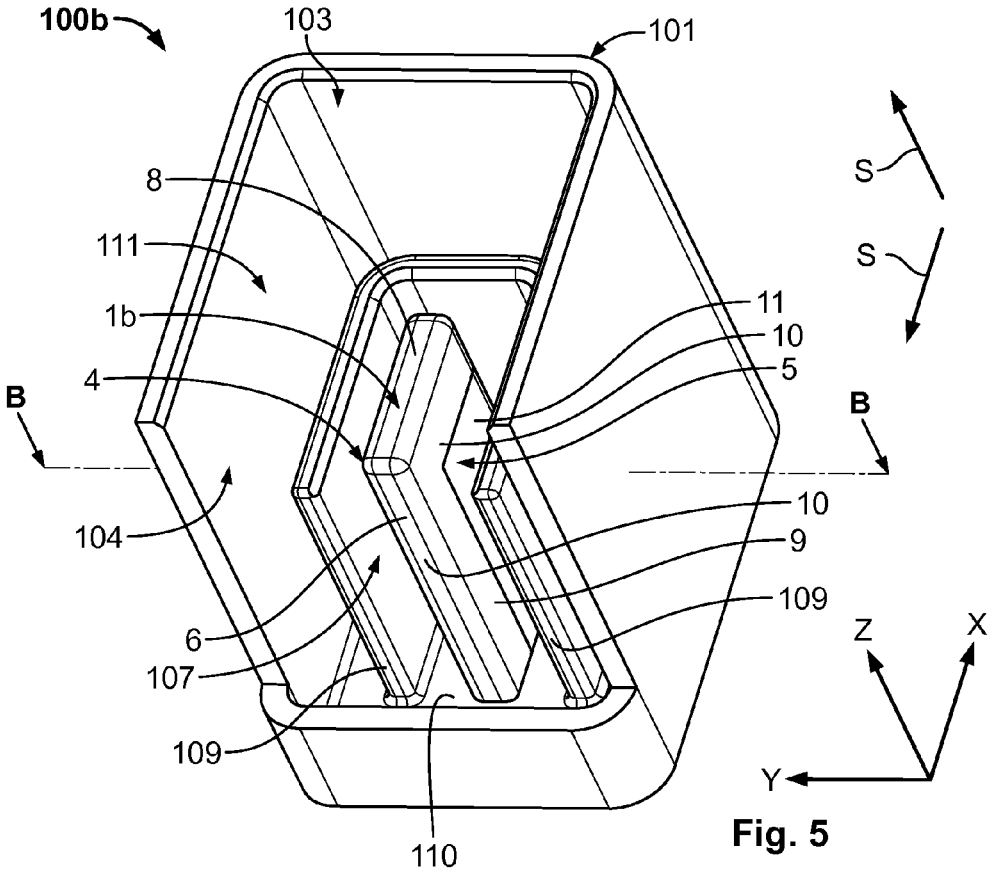
FIG. 5 shows a second embodiment of a connector element according to the invention, with a second embodiment of a pin contact element according to the invention.

FIG. 5 shows a second embodiment of a connector element 100*b* according to the invention, which embodiment is provided with a second embodiment of a pin contact element 1*b* according to the invention. Similarly to the pin contact element 1*a*, the pin contact element 1*b* has a base 2, a free end 3, a contact protection member 4, a contact member 5, a front outer edge 6, a rear outer edge 7, a front-side outer edge 8, a front-side contact protection portion 9, a front-side contact protection portion 10, a first contact face 11 and a second contact face 12 and a connection portion 20. Unlike the pin contact element 1*a* and the connector element 100*a*, the pin contact element 1*b* and the connector element 100*b* are not formed integrally. That is to say, the material of the contact protection member 4 of the pin contact element 1*b* does not merge into the material of the bottom 110 of the connector element 100*b*.

Figure 6:
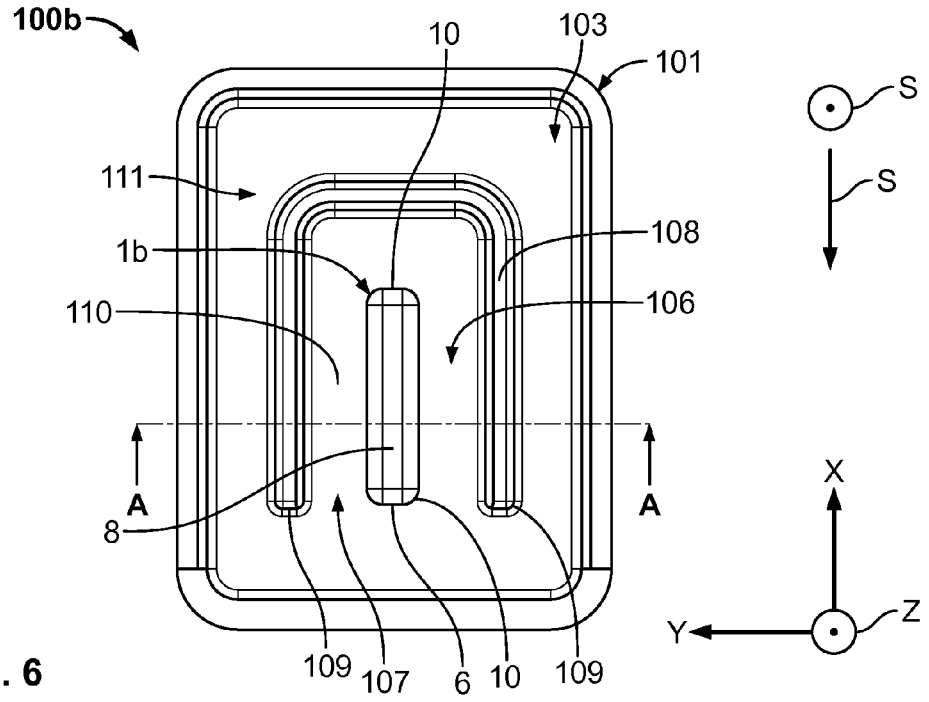
FIG. 6 is a top view of the connector element of the second embodiment.

FIG. 6 is a schematic plan view of the second embodiment of the connector element 100*a*. This shows that the transition illustrated in FIG. 1 between the base 2 and the bottom 110 is not present.

Figure 7:
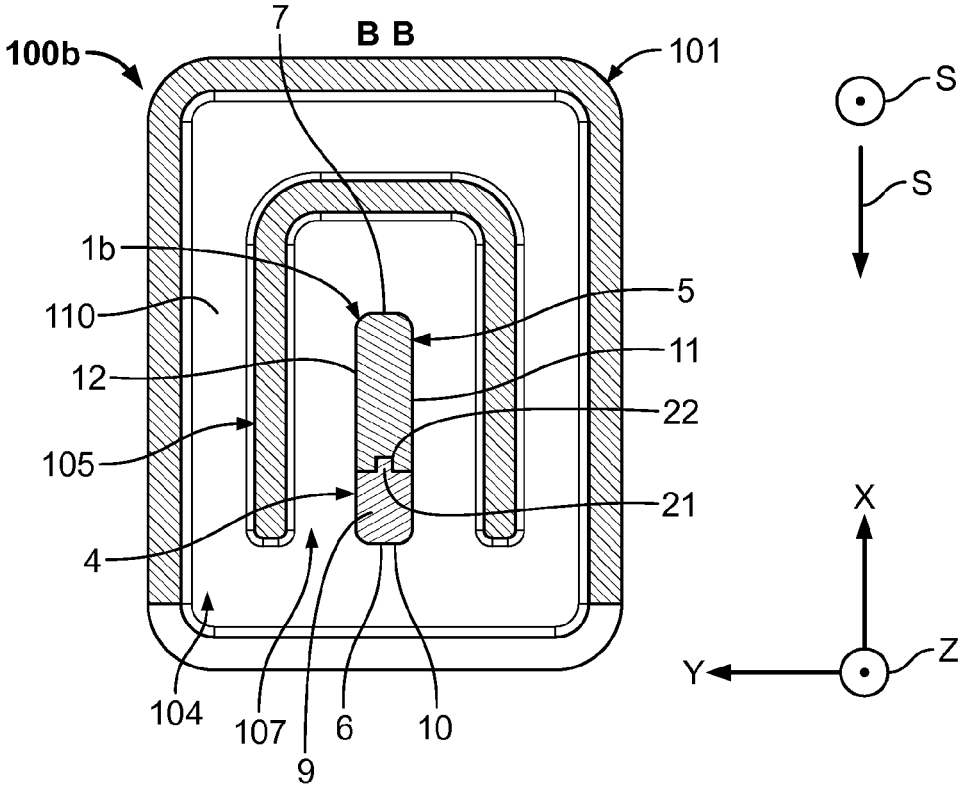
FIG. 7 is a cross-section view of the connector element of the second embodiment along the line of section B-B indicated in FIG. 5.

FIG. 7 is a schematic cross-section of the connector element 100*b* along the line of section B-B indicated in FIG. 5. This shows the solid construction of the contact member 5 of the pin contact element 1*b*. In order to bring about a stabilising positive-locking connection between the contact protection member 4 and the contact member 5 of the pin contact element 1*a*, the contact protection member 4 is provided with a positive-locking element 21 in the form of a tongue which extends substantially parallel with the vertical direction Z and the contact member 5 is provided with a positive-locking counter-element 22 in the form of a groove which is constructed so as to correspond to the positive-locking element 21.

Figure 8:
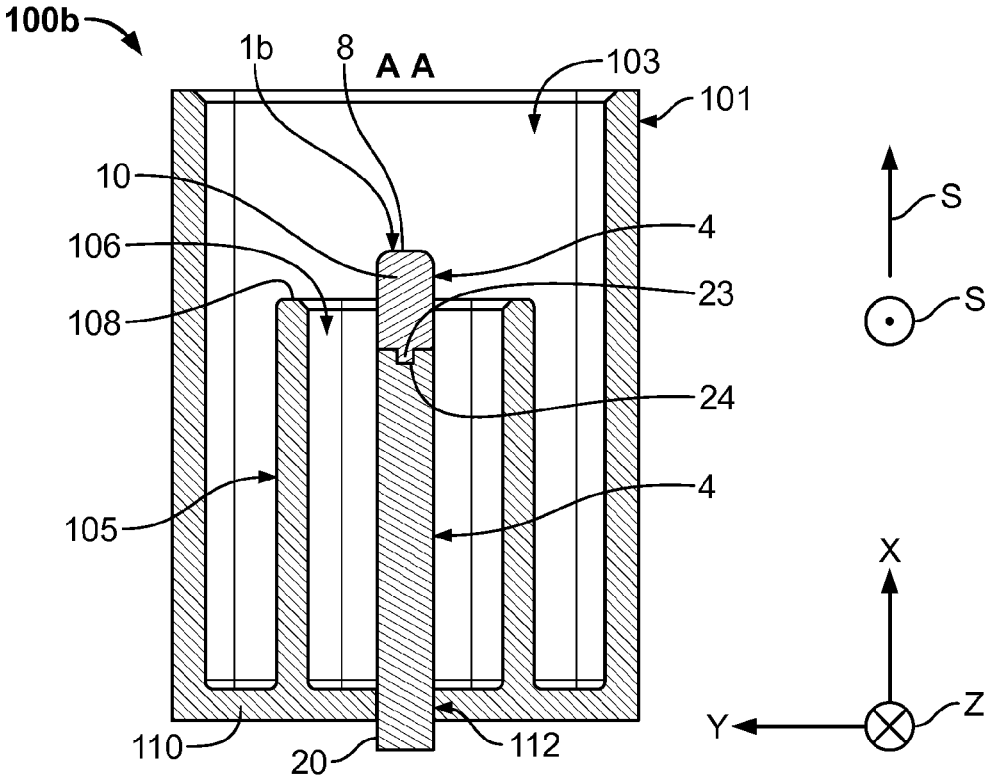
FIG. 8 is a cross-section view of the connector element of the second embodiment along the line of section A-A indicated in FIG. 6.

FIG. 8 is a schematic cross-section of the connector element 100*b* along the line of section A-A indicated in FIG. 6. This shows that, in order to further stabilise the pin contact element 1*b*, similarly to the positive-locking element 21 and the positive-locking counter-element 22, another positive-locking element 23 on the contact protection member 4 and another positive-locking counter-element 24 on the contact member 5 engage with each other and form a tongue and groove connection which extends substantially parallel with the longitudinal direction X.

Furthermore, the contact receiving member 112 in the bottom 110 is formed in the pin contact element 1*b* in such a manner that the entire pin contact element 1*a*, that is to say, the contact protection member 4 and contact member 5, protrudes through the contact receiving member 112 below the bottom 110, where the connection portion 20 of the pin contact element 1*b* is arranged and constructed in accordance with the respective requirements.

Figure 9:
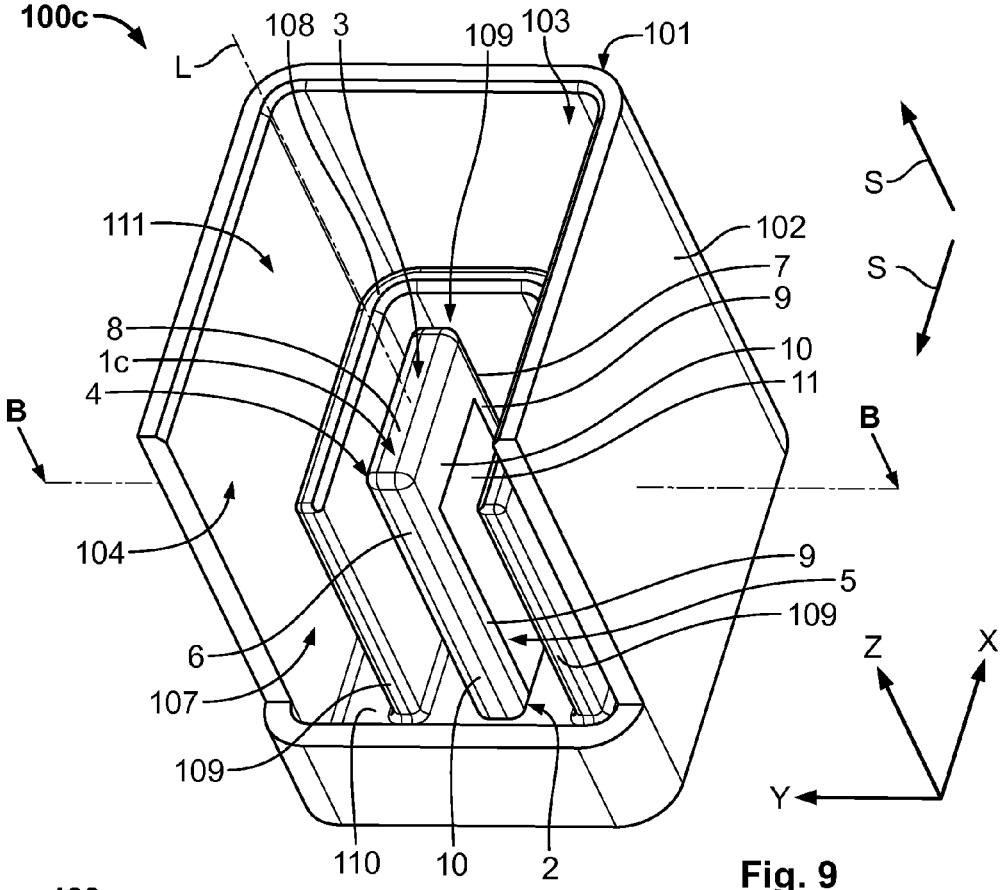
FIG. 9 is a perspective view of a third embodiment of a connector element according to the invention with a third embodiment of a contact element according to the invention.

FIG. 9 shows a third embodiment of a connector element 100*c* according to the invention, which embodiment is provided with a third embodiment of a pin contact element 1*c* according to the invention. Similarly to the pin contact element 1*b*, the pin contact element 1*c* has a base 2, a free end 3, a contact protection member 4, a contact member 5, a front outer edge 6, a rear outer edge 7, a front side 8, a front-side contact protection portion 9, a front-side contact protection portion 10, a first contact face 11 and a second contact face 12 and a connection portion 20, a positive-locking element 21, a positive-locking counter-element 22, another positive-locking element 23 and another positive-locking counter-element 24. The connector element 100*c* has, similarly to the connector element 100*b*, a housing 101, a wall 102, an upper wall opening 103, a lateral wall opening 104, a contact protection collar 105, an upper collar opening 106, a lateral collar opening 107, an upper collar edge 108, a lateral collar edge 109, a bottom 110, a mating connector receiving member 111 and a contact receiving member 112.

Unlike the pin contact elements 1*a* and 1*b*, the pin contact element 1*c* has in the region of the rear outer edge 7 a rear-side contact protection portion 9' which extends, similarly to the front-side contact protection portion 9, from the base 2 as far as the free end 3. The contact protection member 4 extends so as to form an outer face 10' of the contact protection portions 9, 9' of the pin contact 1*c*, from the base 2 as far as the free end 3. Thus, the first contact face 11 and the second contact face 12 are surrounded by the front-side contact protection portion 9, by the rear-side contact protection portion 9' and by the front-side contact protection portion 10. Consequently, the pin contact element 1*c* can be rotated through 180° about its longitudinal axis L, whereby the front-side contact protection portion 9 becomes the rear-side contact protection portion 9', and vice versa. This helps to prevent incorrect equipment of the connector element 110 with the pin contact element 1*c* because one of the contact protection portions 9 or 9' is always directed in the direction of the lateral collar opening 107 and protects the contact faces 11 and 12 from being touched at that location.

Figure 10:
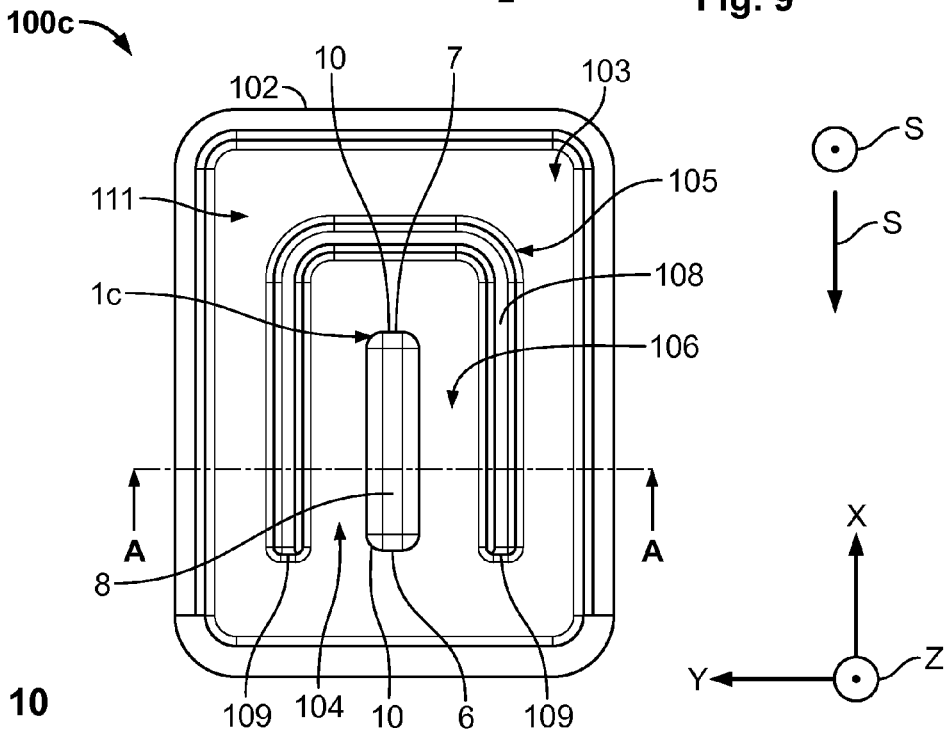
FIG. 10 is a top view of the connector element of the third embodiment.

FIG. 10 is a schematic top view of the connector element 100*c*. This shows that the connector element 100*c* forms the same mating connector receiving member 111 as the connector element 100*a* and the connector element 100*b*.

Figure 11:
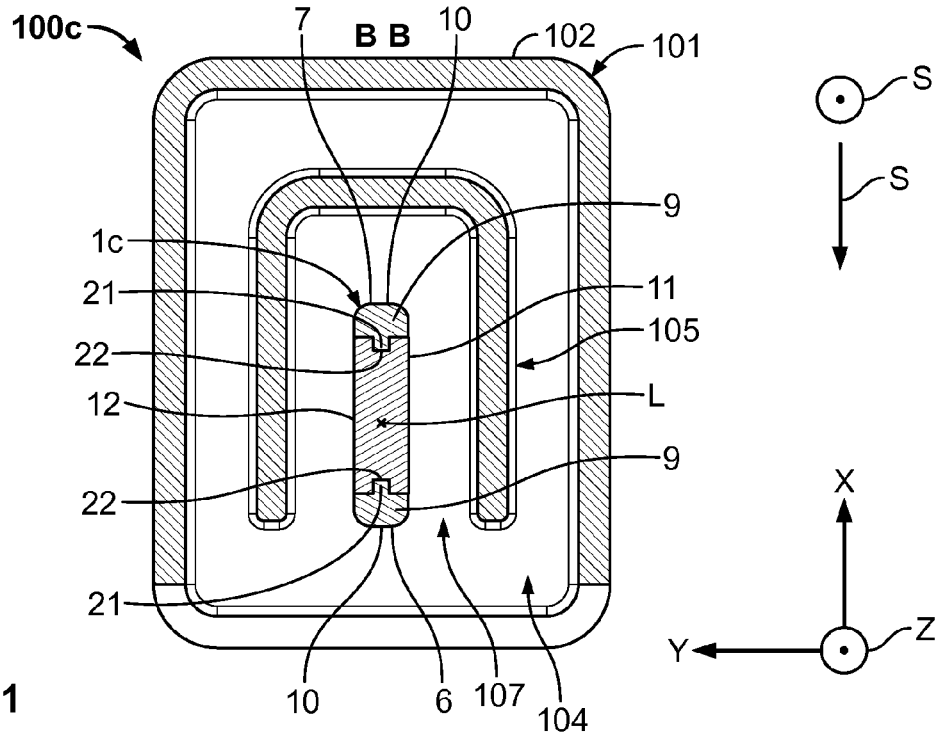
FIG. 11 is a cross-section view of the connector element of the third embodiment along the line of section B-B indicated in FIG. 9.

FIG. 11 is a schematic cross-section of the connector element 100*c* along the line of section B-B indicated in FIG. 9. Similarly to the front-side contact protection portion 9, the rear-side contact protection portion 9' is also provided with a positive-locking element 21. The positive-locking element 21 of the rear contact protection portion 9' engages in a positive-locking counter-element 22 of the contact member 5. The pin contact element 1*a* may, as can be seen in FIG. 11, be constructed in a point-symmetrical manner relative to the longitudinal axis L thereof in a projection in the insertion direction S.

Figure 12:
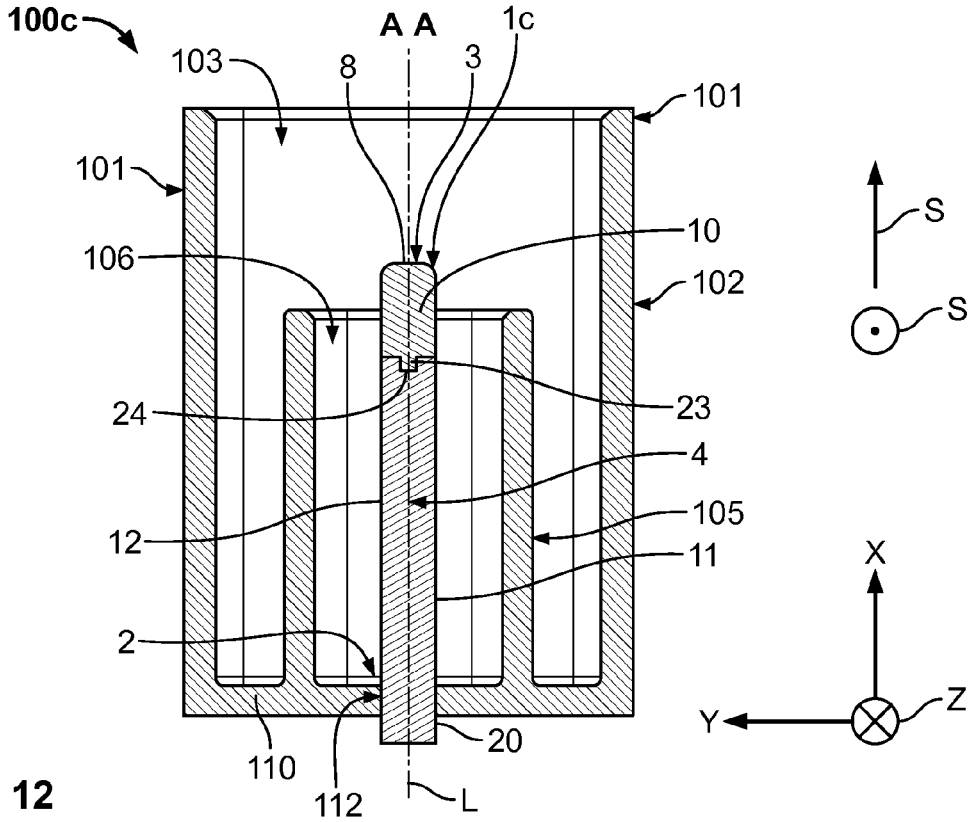
FIG. 12 is a cross-section view of the connector element of the third embodiment along the line of section A-A indicated in FIG. 10.

FIG. 12 is a schematic cross-section of the connector element 100*c* along the line of section A-A indicated in FIG. 10. Similarly to the case of the pin contact element 1*b*, the additional positive-locking element 23 of the front-side contact protection portion 10 engages in the additional positive-locking counter-element 24 in the front side of the contact member 5.

Figure 13:
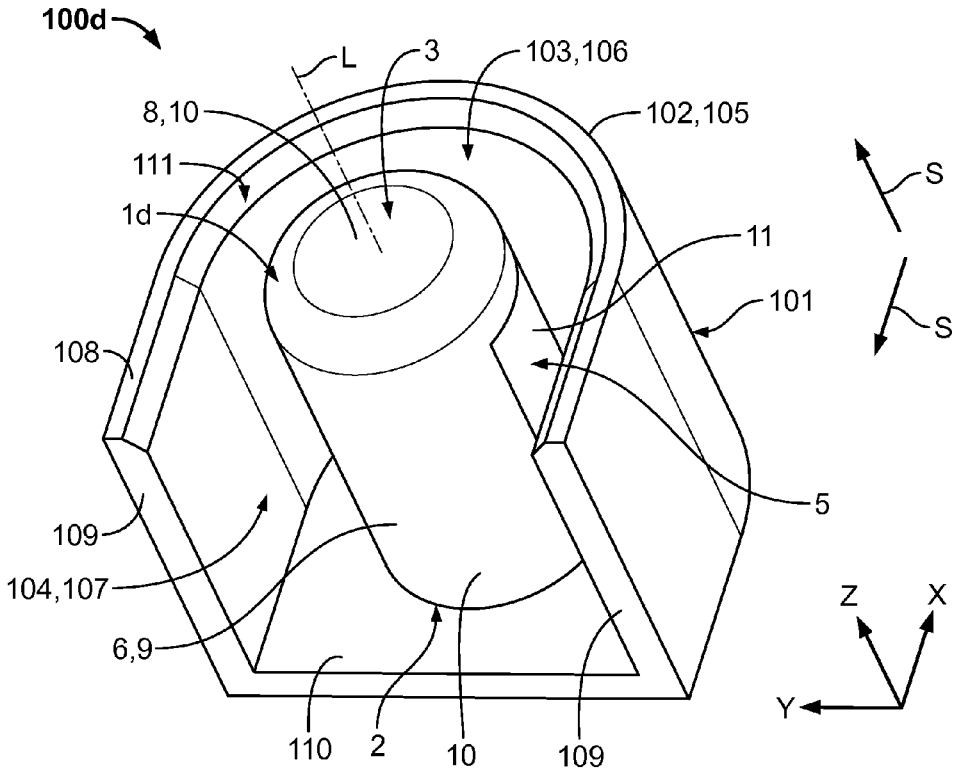
FIG. 13 is a perspective view of a fourth embodiment of a connector element according to the invention with a fourth embodiment of a pin contact element according to the invention.

FIG. 13 shows a fourth embodiment of a connector element 100*d* according to the invention, which embodiment is provided with a fourth embodiment of a pin contact element 1*d* according to the invention. Unlike the pin contact elements 1*a* to 1*c*, the pin contact element 1*d* is in the form of a round contact. Consequently, the pin contact element 1*d* has a cylindrical shape. The cylindrical shape is formed by the contact protection member 4 and contact member 5 of the pin contact element 1*d* in such a manner that a front-side contact protection portion 9 is in the form of a portion of the cylinder outer surface which is complemented by a first contact face 11 of the contact member 5. A front-side contact protection portion 10 of the pin contact element 1*d* forms the substantially circular base face of the cylindrical pin contact element 1*d*. The connector element 100*d* has, unlike the connector elements 100*a* to 100*c*, a wall 102 which simultaneously forms the contact protection collar 105. Consequently, the upper wall opening 103 corresponds to the upper collar opening 106 and the lateral wall opening 104 corresponds to the lateral collar opening 107 in the connector element 100*d*.

Figure 14:
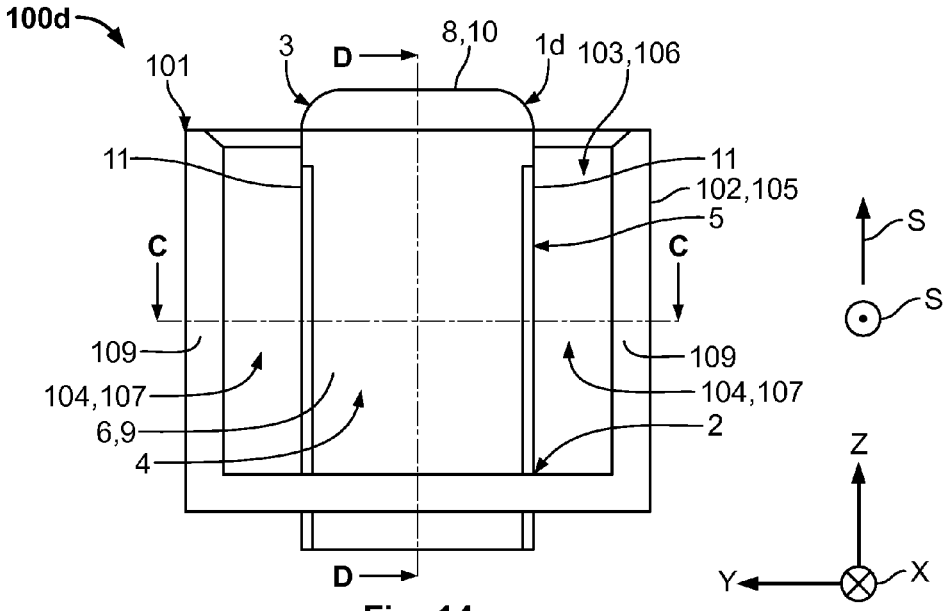
FIG. 14 is a front view of the connector element of the fourth embodiment.

FIG. 14 is a schematic front view of the connector element 100*d*. This shows that the contact face 111 covers more than 180° of the outer face of the pin contact element 1*d*. Consequently, the contact face 111 of the pin contact element 1*d* is accessible through the lateral wall opening 104 or the lateral collar opening 107 substantially parallel with the additional insertion direction S'. Therefore, it is possible to contact the contact member 5 both in the insertion direction S with a counter-contact element formed, for example, as a round counter-contact, and in the counter-insertion direction S' with a, for example, fork-like counter-contact element in a projection transversely relative to the counter-insertion direction S', whereby the connector element 100*d* is suitable both for 90° and for 180° plug type connections.

Figure 15:
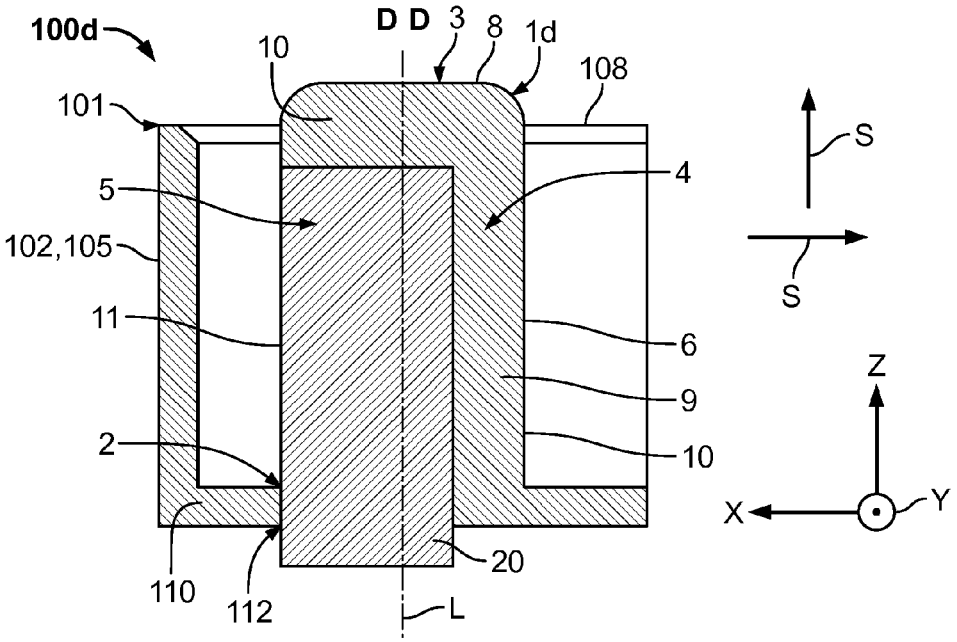
FIG. 15 is a cross-section view of the connector of the fourth embodiment along the line of section D-D indicated in FIG. 14.

FIG. 15 is a schematic cross-section of the connector element 100*d* along the line of section D-D indicated in FIG. 14. This shows that the contact member 5 of the pin contact element 1*d* is of solid form and that there are provided no positive-locking elements which connect the contact member 5 of the pin contact element 1*d* to the contact protection member 4 of the pin contact element 1*d*. Similarly to the case of the pin contact element 1*a* and the connector element 100*a*, the contact protection member 4 of the pin contact element 1*d* is integrally formed with the housing 101 of the connector element 100*d*. In the region of the base of the second pin contact element 1*d*, the material of the pin contact element 1*d* merges into the material of the bottom 110 of the connector element 100*d*.

Figure 16:
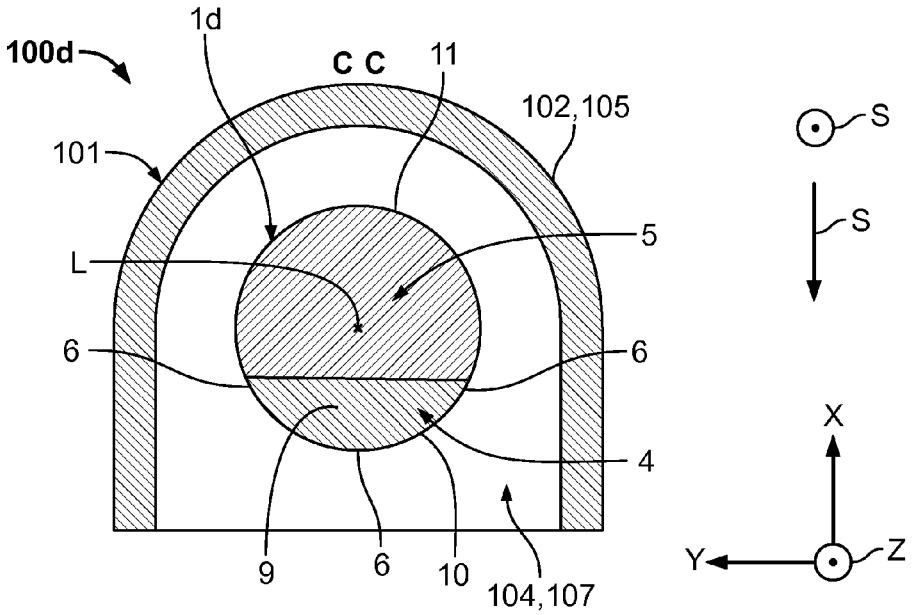
FIG. 16 is a cross-section view of the connector element of the fourth embodiment along the line of section C-C indicated in FIG. 14.

FIG. 16 is a schematic cross-section of the connector element 100*d* along the line of section C-C indicated in FIG. 14. There are also provided between the contact protection member 4 and the contact member 5 no positive-locking elements at all. The first portion of the outer radius of the contact face 11 of the pin contact element 1*d*, which radius forms the cylindrical surface of the pin contact element 1*d*, is greater than the outer radius of the front-side contact protection portion 9 which complements the cylindrical face. It should be noted that the spacing between the wall 102 or the contact protection collar 105 in the additional insertion direction S' at the height of the boundary face between the contact protection member 4 and the contact member 5 is selected to be so small that a test finger cannot be brought into touching contact with the contact face 11 counter to the insertion direction S' through the lateral wall opening 104 or lateral collar opening 107 of the connector element 100*d*, but instead adjoins the front-side contact protection portion 9.

Figure 17:
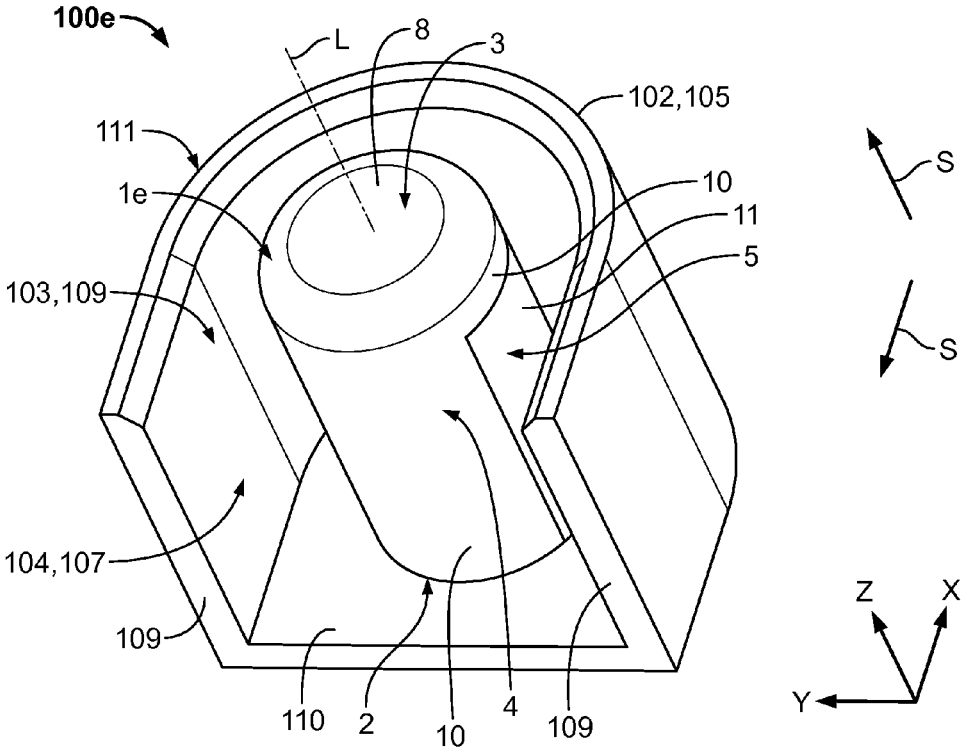
FIG. 17 shows a fifth embodiment of a connector element according to the invention with a fifth embodiment of a pin contact element according to the invention.

FIG. 17 shows a fifth embodiment of a connector element 100*e* according to the invention, which embodiment is provided with a fifth embodiment of a pin contact element 1*e* according to the invention, with the pin contact element 1*e* being constructed similarly to the pin contact element 1*d* as a round contact. Similarly to the pin contact element 1*d*, the pin contact element 1*e* has a base 2, a free end 3, a contact protection member 4, a contact member 5, a front outer edge 6, a rear outer edge 7, a front side 8, a front-side contact protection portion 9, a front-side contact protection portion 10 and a contact face 11. An outer face 10' of the contact protection portion 9 is formed by the contact protection member 4 which extends from the base 2 as far as the free end 3. Similarly to the connector element 100*d*, the connector element 100*e* has the housing 101 with a wall 102 or a contact protection collar 105, an upper wall opening 103 or an upper collar opening 106, a lateral wall opening 104 or a lateral collar opening 107, an upper collar edge 108, a lateral collar edge 109, a bottom 110 and a contact receiving member 112, and forms a mating connector receiving member 111. Unlike the pin contact element 1*d*, the pin contact element 1*e* has a rear-side contact protection portion 9' which is arranged similarly to the pin contact element 1*c* at the side of the pin contact element 1*e* facing away from the lateral wall opening 104 or lateral collar opening 107.

Figure 18:
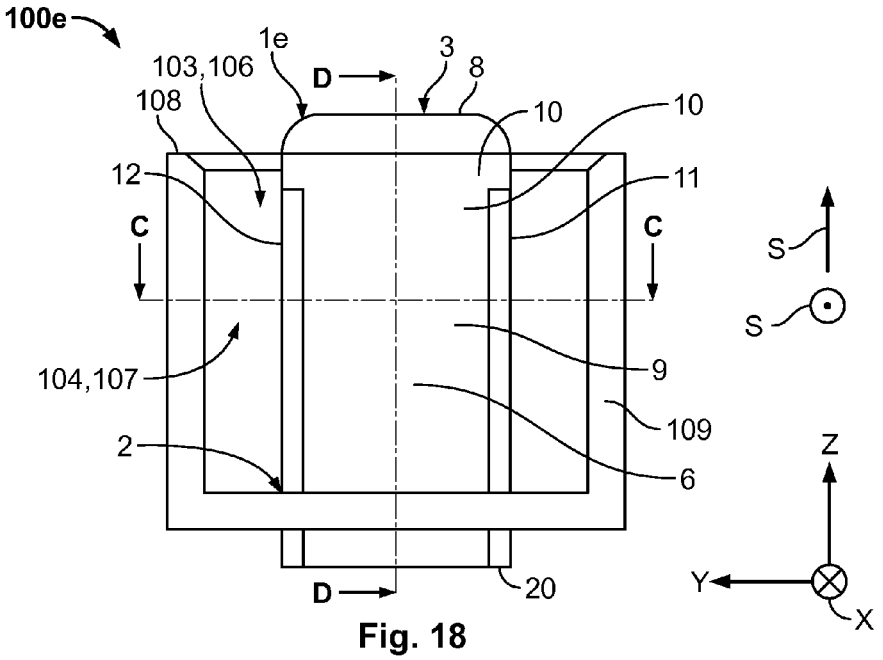
FIG. 18 is a front view of the connector element of the fifth embodiment.

FIG. 18 is a schematic front view of the connector element 100*e*. This shows that the pin contact element 1*e* and the pin contact element 1*d* appear to be identical in a projection counter to the additional insertion direction S'.

Figure 19:
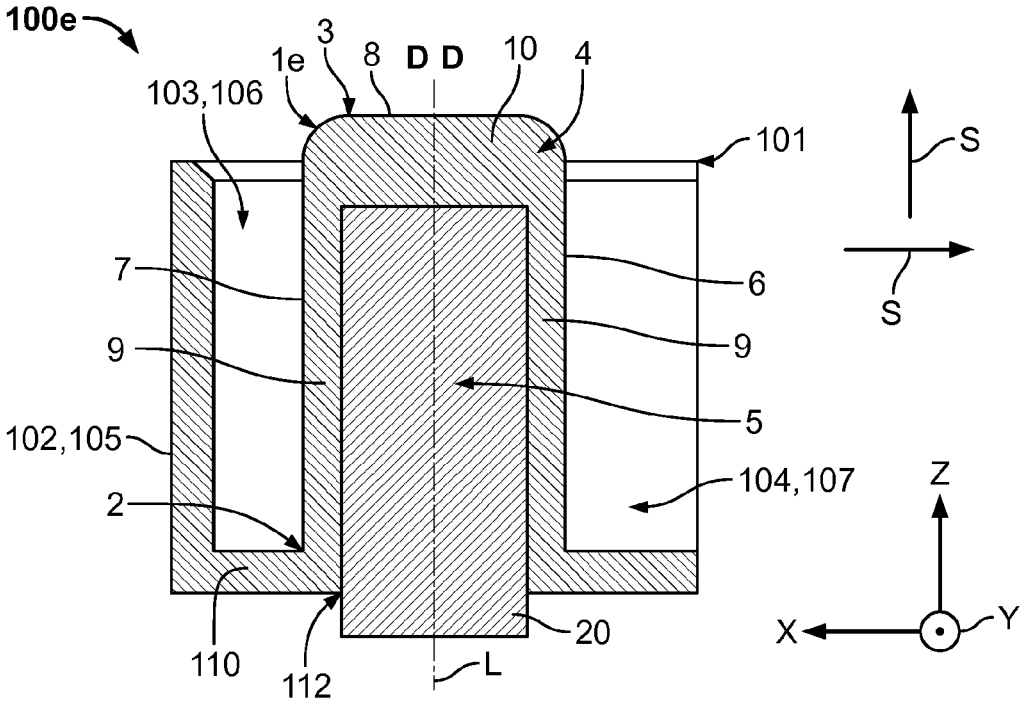
FIG. 19 is a cross-section view of the connector of the fifth embodiment along the line of section D-D indicated in FIG. 18.

FIG. 19 is a schematic cross-section of the connector element 100*e* along the line of section D-D indicated in FIG. 18. This shows that the rear-side contact protection portion 9' of the pin contact element 1*e* is arranged at the side thereof facing away from the lateral wall opening 104 or lateral collar opening 107 and the contact member 5 of the pin contact element 1*e* is surrounded in cross-section by the front-side contact protection portion 9, rear side contact protection portion 9' and front-side contact protection portion 10. The front-side contact protection portion 9 and the rear-side contact protection portion 9' are formed, similarly to with the pin contact element 1*a*, integrally with the housing 101 or the bottom 110 of the connector element 100*e*. The connection portion 20 of the pin contact element

1*e* projects through the contact receiving member 112 of the connector element 100*e* below the bottom 110 of the connector element 100*e*.

Figure 20:
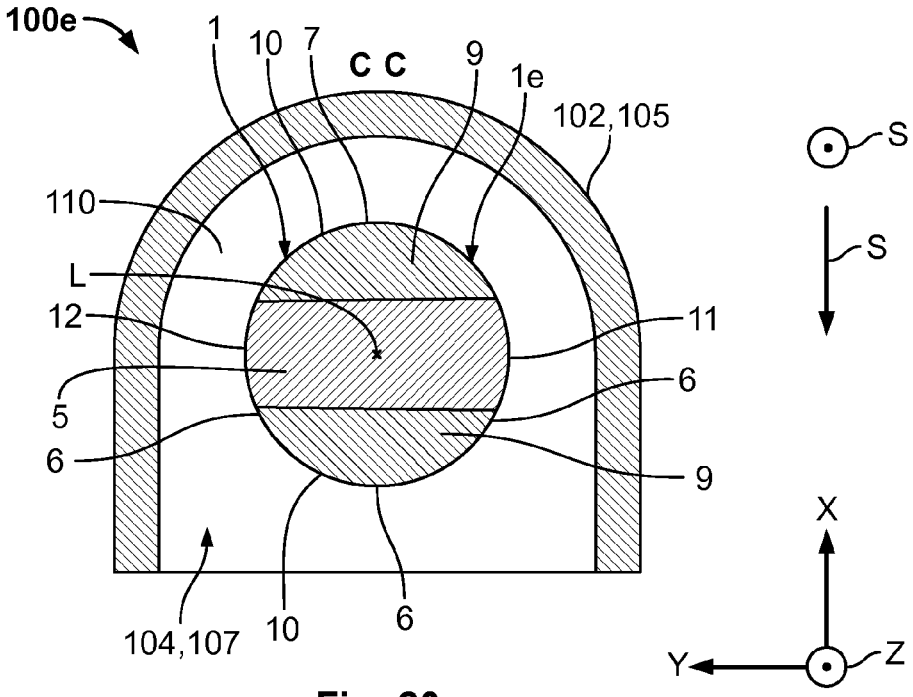
FIG. 20 is a cross-section view of the connector element of the fifth embodiment along the line of section C-C indicated in FIG. 18.

FIG. 20 is a schematic cross-section of the connector element 100*e* along the line of section C-C indicated in FIG. 18. This shows that the front-side contact protection portion 9 and the rear-side contact protection portion 9' surround the contact member 5 of the pin contact element 1*e* in a projection in or counter to the transverse direction Y, which consequently forms a first contact face 11 and a second contact face 12 similarly to the contact members 5 of the pin contact elements 1*a* to 1*c*. The outer faces 10' of the front-side contact protection portion 9, the rear-side contact protection portion 9' and the first contact face 11 and the second contact face 12 of the pin contact element 1*e* together form the cylindrical outer surface thereof. As in the other embodiments, the contact protection member 4 also extends externally on the pin contact element if from the base 2 as far as the free end 3. It forms the outer faces 10' of the contact protection portions 9, 9'.

Figure 21:
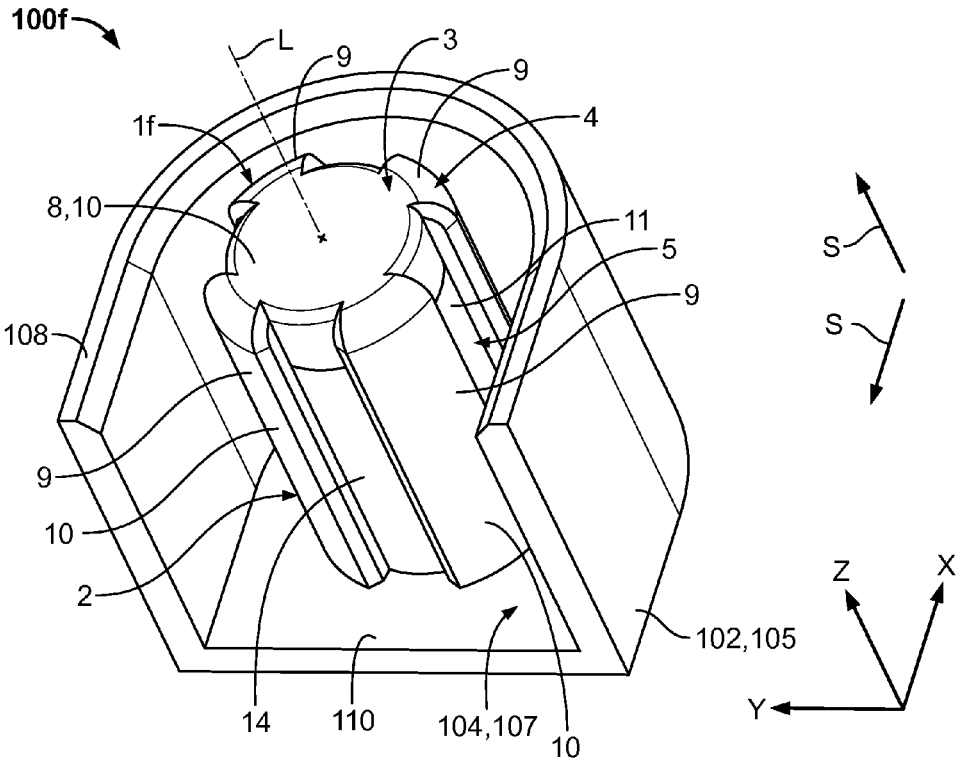
FIG. 21 shows a sixth embodiment of a connector element according to the invention with a sixth embodiment of a pin contact element according to the invention.

FIG. 21 shows a sixth embodiment of a connector element 100*f* according to the invention, which embodiment is provided with a sixth embodiment of a pin contact element 1*f* according to the invention. Similarly to the pin contact elements 1*d* and 1*e*, the pin contact element 1*f* is in the form of a round contact. Unlike the pin contact elements 1*d* and 1*e*, the pin contact element if has a contact protection member 4 which has a front-side and four front-side and rear-side contact protection portions. A front-side contact protection portion 9 and a rear-side contact protection portion 9' of the pin contact element 1*f* are arranged diametrically opposite each other when viewed from above with respect to the longitudinal axis L of the pin contact element if in a manner substantially parallel with the insertion direction S. The contact member 5 of the pin contact element 1*f* is constructed so as to be solid and cylindrical. The contact protection portions 9 and 9' are arranged spaced apart from the cylindrical outer face of the contact member 5 of the pin contact element 1*f*. The front-side contact protection portion 10 of the pin contact element 1*f* connects the contact protection portions 9 and 9' to each other so that the contact protection portions 9, 9' and 10 of the pin contact element if form a type of contact protection cage around the contact member 5. A first, second, third and fourth contact face 1 to 14 of the pin contact element if are formed between the contact protection portions 9, 9' and 10. The connector element if further has a housing 101 which is constructed substantially similarly to the housings 101 of the connector elements 100*d* and 100*e* in that there are combined the wall 102 and contact protection collar 105 and consequently the upper wall opening 103 with the upper collar opening 106 and lateral wall opening 104 with a lateral collar opening 107.

Figure 22:
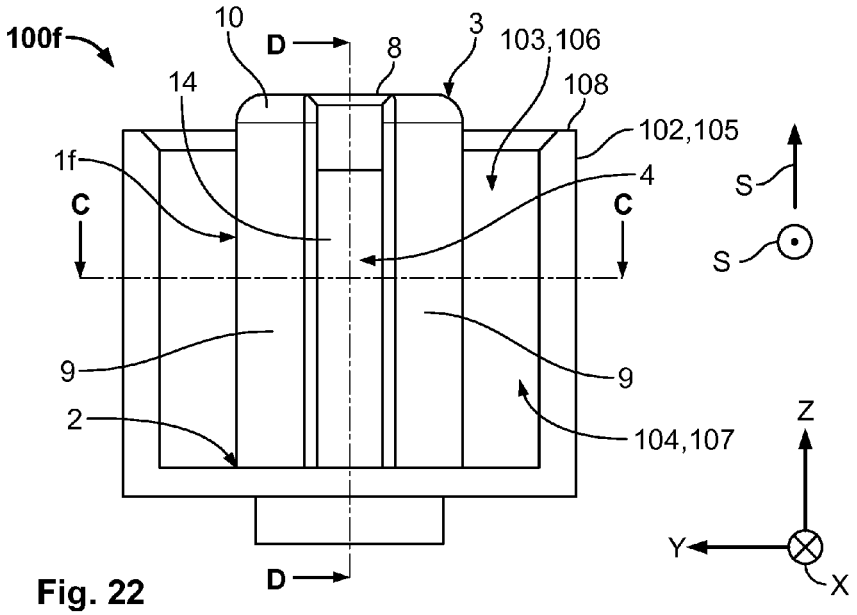
FIG. 22 is a front view of the connector element of the sixth embodiment.

FIG. 22 is a schematic front view of the connector element 100*f*. This shows that the front-side contact protection portion 10 projects beyond the upper collar edge 108 of the connector element 100*f* counter to the insertion direction S.

Figure 23:
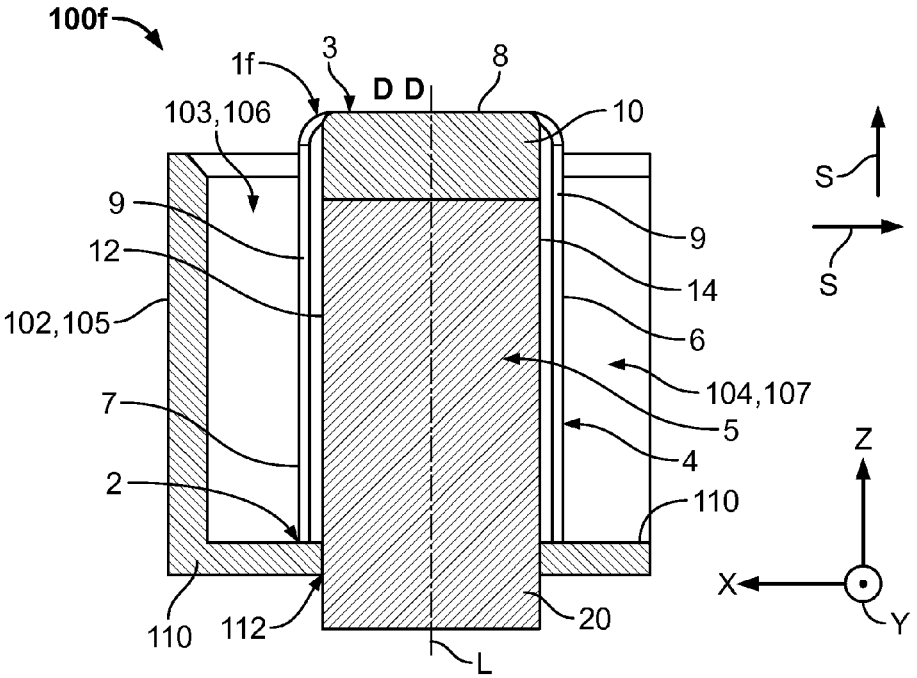
FIG. 23 is a cross-section view of the connector element of the sixth embodiment along the line of section D-D indicated in FIG. 22.

FIG. 23 is a schematic cross-section of the connector element 100*f* along the line of section D-D indicated in FIG. 22. This shows that the contact member 5 of the pin contact element 1*f* is constructed in a solid manner and projects downwards with its connection portion 20 through the contact receiving member 112 of the connector element 111 through the bottom 110 thereof. The front-side and rear-side contact protection portions 9 and 9' extend substantially parallel with the insertion direction S along the contact member 5 or the cylindrical surface thereof and form front and rear outer edges 6 and 7 of the contact protection member 4 of the pin contact element 1*f*. The contact protection member 4 may be constructed integrally with the bottom 110 of the connector element 100*f* on the base 2 of the pin contact element 1*f*, as may also be the case, for example, in the connector elements 100*a* and 100*d* to 100*e*.

Figure 24:
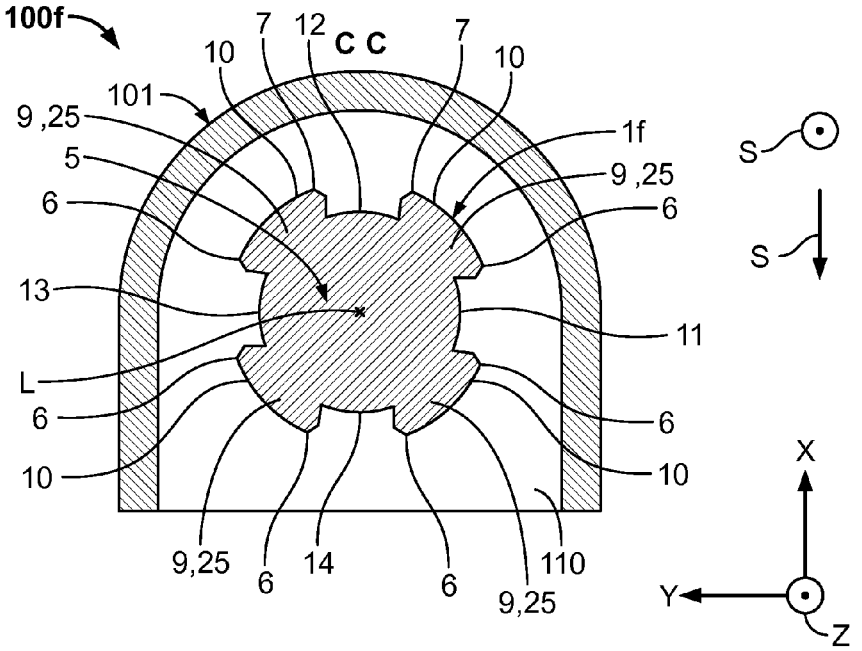
FIG. 24 is a cross-section view of the connector of the sixth embodiment along the line of section C-C indicated in FIG. 22.

FIG. 24 is a schematic cross-section of the connector element 100*f* along the line of section C-C indicated in FIG. 22. This shows the concentric arrangement of the front-side and rear-side contact protection portions 9 and 9' of the contact protection member 4 of the pin contact element 1*f*, which portions 9 and 9' are diametrically opposite each other with respect to the longitudinal axis L and surround the cylindrical contact member 5 of the pin contact element 1*f* in the manner of a circle segment and surround first to fourth contact faces 11 to 14 and form front outer edges 6, rear outer edges 7 and furthermore central outer edges 6'. The outer contour of the pin contact element 1*f*, which outer contour is consequently formed in a projection in the insertion direction S, therefore brings about an encoding which requires that a counter-contact element which can be connected to the pin contact element 1*f* be constructed at least partially so as to correspond to the outer contour of the pin contact element if so that it can be connected thereto in the insertion direction S and reliably contacts at least one of the four contact faces 1 to 14. Consequently, the contact protection portions 9 and 9' of the pin contact element act as encoding elements 25 which determine a correct orientation of the counter-contact element relative to the pin contact element 1*f*.

Figure 25:
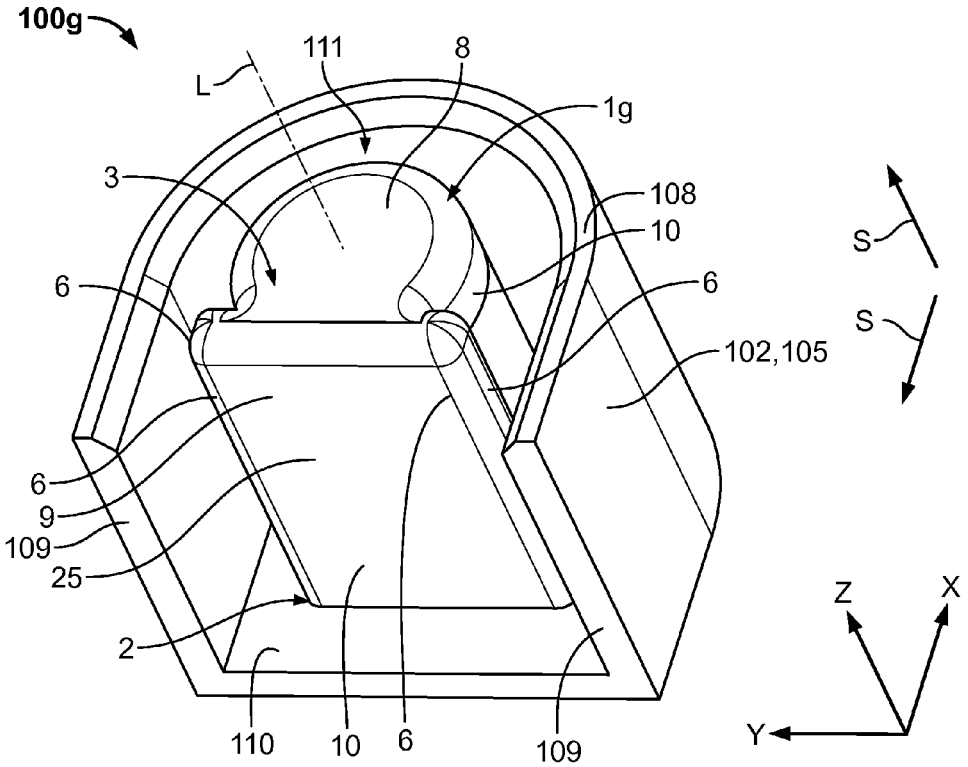
FIG. 25 is a perspective view of a seventh embodiment of a connector element according to the invention with a seventh embodiment of a pin contact element according to the invention.

FIG. 25 shows a seventh embodiment of a connector element 100*g* according to the invention, which embodiment is provided with a seventh embodiment of a pin contact element 1*g* according to the invention. The pin contact element 1*g* is constructed similarly to the pin contact elements 1*d* to 1*f* as a type of round contact. The contact member 5 of the pin contact element 1*g* is equivalent to the contact member 5 of the pin contact element 1*d*. Unlike the pin contact elements 1*a* to 1*f*, the pin contact element 1*g* is constructed asymmetrically with respect to the longitudinal axis L thereof. That is to say, in a projection in the insertion direction S, the pin contact element 1*g* has an outer contour which is intended to determine a single correct orientation of a counter-contact element which can be connected to the pin contact element 1*g*. The front-side contact protection portion 9 of the pin contact element 1*g* is constructed in such a manner that it forms a face which is substantially in a plane defined by the transverse direction Y and the vertical direction Z. At lateral edges of the front-side contact protection portion 9 of the pin contact element 1*g*, consequently, two front outer edges 6 are formed. Furthermore, the front contact protection portion 9 of the pin contact element 1*g* forms central outer edges 6'.

The connector element 100*g* has, similarly to the connector element 100*d* to 100*f*, a housing 101 in which the wall 102 is combined with the contact protection collar 105 and consequently the upper wall opening 103 is combined with the upper collar opening 106 and the lateral wall opening 104 is combined with the lateral collar opening 107.

Figure 26:
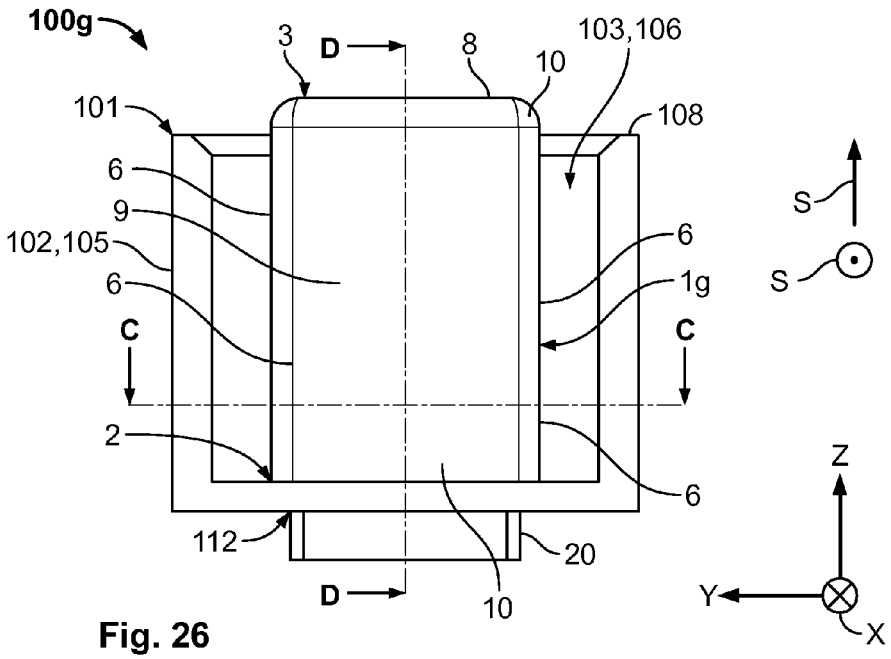
FIG. 26 is a front view of the connector element of the seventh embodiment.

FIG. 26 is a schematic front view of the connector element 100*g*. This shows that, similarly to the case for the connector elements 100*a* to 100*f*, the front-side contact protection portion 10 also projects beyond the upper collar edge 108.

Figure 27:
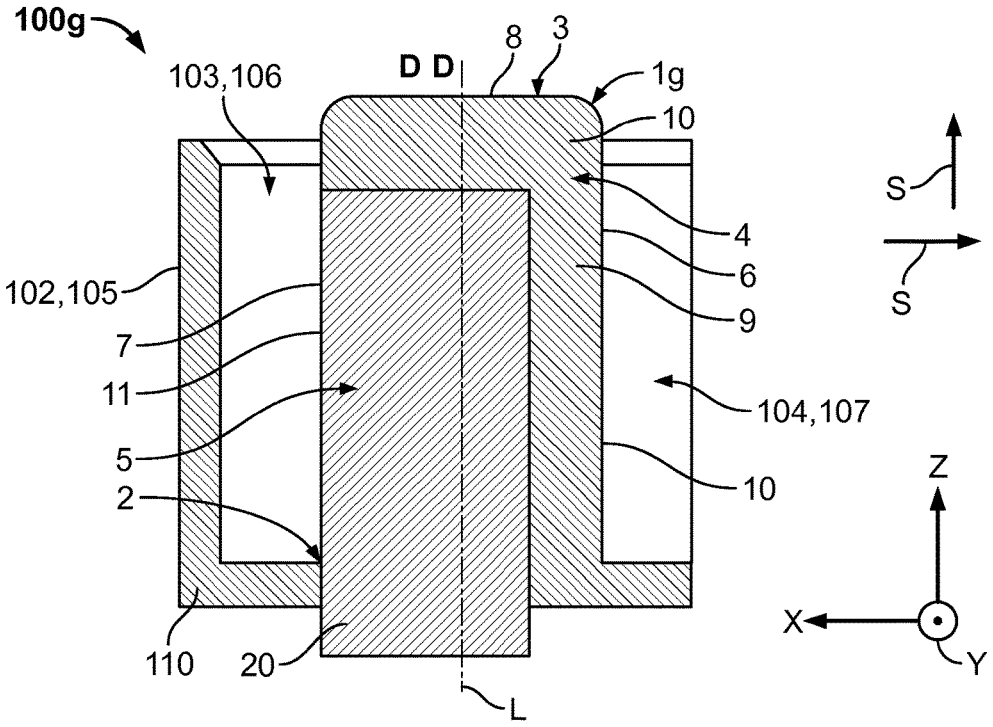
FIG. 27 is a cross-section view of the connector element of the seventh embodiment along the line of section D-D indicated in FIG. 26.

FIG. 27 is a schematic cross-section of the connector element 100*g* along the line of section D-D indicated in FIG.

26. This shows that the contact protection member 4 of the pin contact element 1*g* is constructed integrally with the connector element 100*g*. That is to say, in the region of the base 2 of the pin contact element 1*g*, the material of the contact protection member 4 merges into the material of the bottom 110 of the housing 101 of the connector element 100*g*.

Figure 28:
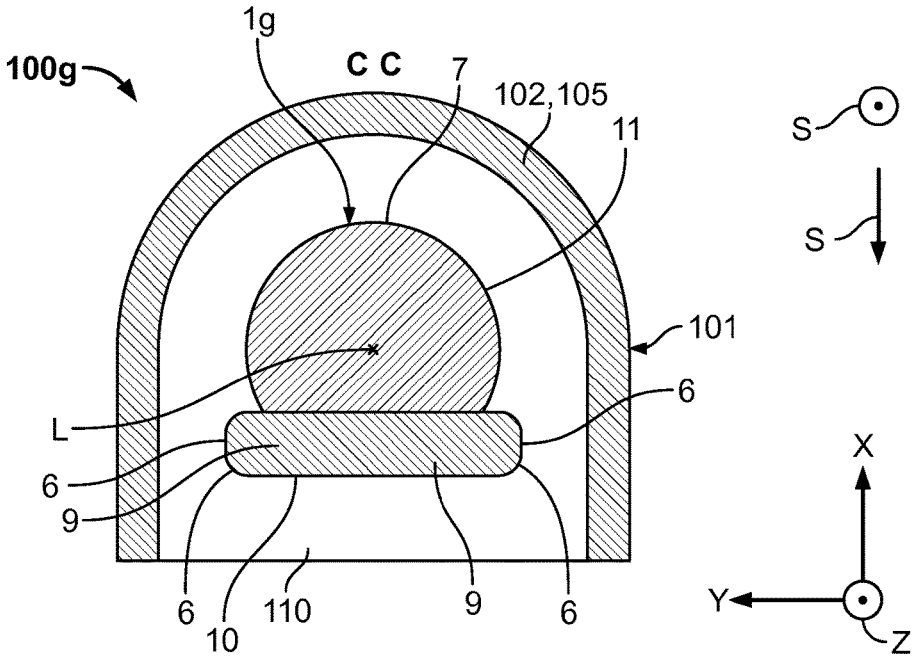
FIG. 28 is a cross-section view of the connector element of the seventh embodiment along the line of section C-C indicated in FIG. 26.

FIG. 28 is a schematic cross-section of the connector element 100*g* along the line of section C-C indicated in FIG. 26. This shows that the front-side contact protection portion 9 provides a type of barrier which faces the lateral wall opening 104 or lateral collar opening 107. The front-side contact protection portion 9 is constructed in such a manner that the central outer edges 6' reduce a spacing or free space between the contact protection member 4 and the wall 102 or the contact protection collar 105 to such an extent that introduction through that free space substantially counter to the additional insertion direction S' with a test finger is prevented.

Within the notion of the invention, deviations from the above-described embodiments are possible. Thus, pin contact elements 1*a* to 1*g* according to the invention may be constructed in accordance with requirements so as to have a base 2 and a free end 3, between which a contact protection member 4 in a form as required extends in order to prevent contact of a test finger with the electrically conductive contact member 5 of the pin contact element 1*a* to 1*g* in accordance with the respective standards and guidelines. To that end, in accordance with the respective requirements, the contact protection member 4 may have any number of front outer edges 6, rear outer edges 7, front sides 8, front-side contact protection portions 9, front-side contact protection portions 10, positive-locking elements 21, additional positive-locking elements 23 and encoding elements 25, which may be constructed as desired. The contact member 5 may have, in accordance with the respective requirements, any number of contact faces 11 to 14 and positive-locking counter-elements 22 and additional positive-locking counter-elements 24, which may be constructed in any manner, and may be provided with a connection portion 20 which may be constructed in any manner. The positive-locking elements 21, 23 and the positive-locking counter-elements 22, 24 may be constructed in accordance with the respective requirements in order to produce a positive-locking connection which is as stable as possible between the contact protection member 4 and the contact member 5. Consequently, any positive-locking elements 21, 23 and/or positive-locking counter-elements 22, 24 in the form of grooves may have undercuts. Positive-locking elements 21, 23, 24 may be of dovetail-like form in order to increase the stability of the mechanical connection between the contact protection member 4 and the contact member 5.

A connector element 100*a* to 100*g* according to the invention may be constructed in accordance with the respective requirements so as to have a housing 101 which may form any number of contact receiving members 112 which correspond to the number and shape of the desired pin contact elements 1*a* to 1*g*. The wall 102, upper wall opening 103, lateral wall opening 104, the contact protection collar 105, the upper collar opening 106, lateral collar opening 107, upper collar edge 108, lateral collar edge 109 and the bottom 110 may be constructed in accordance with the respective requirements in order to determine at least a mating connector receiving member 111 or an insertion face which allows connection of the connector element 100*a* to 100*g* to a mating connector element in an insertion direction S and/or an additional insertion direction S', the insertion direction S and S' being able to be associated, for example, with a 180° plug type connector or a 90° plug type connector, as described herein.

Elements of the housing 101 and the contact protection member 4 may be produced in accordance with the respective requirements from any electrically insulating material. It is advantageous to construct the housing 101 at least partially integrally on the contact protection member 4. To that end, the housing 101 and the contact protection member 4 may be, for example, cast or injection moulded in an operating step or otherwise be produced from a material corresponding to requirements, such as a plastics material. It is also possible to use different materials for the contact protection member 4 and housing 101.

The spacings between the contact protection portions 9, 9' and 10 and walls 102 or contact protection collar 105 are intended to be selected in the longitudinal direction X, transverse direction Y and vertical direction Z or insertion direction S and additional insertion direction S' so that contact with the contact member 5 through upper wall openings 103, upper collar openings 106, lateral wall openings 104 and lateral collar openings 107 with a human finger or the test finger which is intended to be used in accordance with the respective standards and guidelines is prevented.

What is claimed is:

1. An electrical pin contact, comprising:

a free end;

a base spaced apart from the free end;

an electrically insulating contact protection member forming two opposing exterior sides of the electrical pin contact extending from the base to the free end; and a contact member forming a portion of two other opposing exterior sides of the electrical pin contact and aligned with a surface of the contact protection member.

2. The electrical pin contact according to claim 1, wherein the shape of the contact protection member defines an insertion direction and/or insertion orientation for connecting to a mating contact.

3. The electrical pin contact according to claim 1, wherein the contact protection member forms a front side at the free end.

4. The electrical pin contact according to claim 1, wherein the contact protection member at least partially surrounds the contact member.

5. The electrical pin contact according to claim 1, wherein the contact protection member and the contact member engage one another in a positive locking manner.

6. The electrical pin contact according to claim 1, wherein the contact protection member is insulative.

7. An electrical connector, comprising:

a bottom surface;

a housing forming a plurality of open sides; and an electrical pin contact having a free end, a base spaced apart from the free end and connected to the bottom surface, an electrically insulating contact protection member extending from the base to the free end and forming a plurality of exterior faces of the electrical pin contact which each face one of the plurality of open sides of the housing, and a contact member forming a portion of the exterior of the electrical pin contact and aligned with a surface of the contact protection member.

8. The electrical connector according to claim 7, wherein the bottom surface, housing and contact protection member are integrally formed.

9. The electrical connector according to claim 7, wherein the contact protection member at least partially surrounds the contact member.

10. The electrical connector according to claim 9, wherein the contact protection member and the contact member engage one another in a positive locking manner.

11. The electrical connector according to claim 10, wherein the electrical pin contact is a cylindrical shape.

12. The electrical connector according to claim 10, wherein the electrical pin contact is in the shape of a flat contact.

13. The electrical connector according to claim 9, further comprising a contact protection collar attached to the bottom surface and disposed between the housing and the electrical pin contact.

14. The electrical connector according to claim 13, wherein the contact protection collar forms a plurality of open sides which face the same direction as the plurality of open sides of the housing.

15. The electrical connector according to claim 14, wherein the contact protection collar extends further from the bottom surface than the contact member.

16. The electrical connector according to claim 15, wherein the electrical pin contact extends further from the bottom surface than the contact protection collar.

17. The electrical connector according to claim 16, wherein the bottom surface, housing, contact protection member, and contact protection collar are integrally formed.

* * * * *